US011253135B2

(12) United States Patent
Krieger et al.

(10) Patent No.: US 11,253,135 B2
(45) Date of Patent: Feb. 22, 2022

(54) MOTOR DRIVEN IN-DOOR DISHWASHER AID DISPENSER

(71) Applicant: Illinois Tool Works Inc., Glenview, IL (US)

(72) Inventors: Jeffrey J. Krieger, Mukwonago, WI (US); Michael Osvatic, Waukesha, WI (US); Jonathan H. Olson, Sussex, WI (US)

(73) Assignee: Illinois Tool Works Inc., Glenview, IL (US)

( * ) Notice: Subject to any disclaimer, the term of this patent is extended or adjusted under 35 U.S.C. 154(b) by 147 days.

(21) Appl. No.: 16/095,809

(22) PCT Filed: May 2, 2017

(86) PCT No.: PCT/US2017/030537
§ 371 (c)(1),
(2) Date: Oct. 23, 2018

(87) PCT Pub. No.: WO2017/209882
PCT Pub. Date: Dec. 7, 2017

(65) Prior Publication Data

US 2019/0125160 A1 May 2, 2019

Related U.S. Application Data

(60) Provisional application No. 62/343,959, filed on Jun. 1, 2016.

(51) Int. Cl.
*A47L 15/44* (2006.01)

(52) U.S. Cl.
CPC ..... *A47L 15/4409* (2013.01); *A47L 15/449* (2013.01); *A47L 2401/02* (2013.01);
(Continued)

(58) Field of Classification Search
CPC ..... A47L 15/44–449; A47L 15/00–508
See application file for complete search history.

(56) References Cited

U.S. PATENT DOCUMENTS 2,832,366 A * 4/1958 Farison ..... A47L 15/4427 137/132
2,973,769 A * 3/1961 Jacobs ..... A47L 15/4409 134/58 D (Continued)

FOREIGN PATENT DOCUMENTS

CN 101005788 A 7/2007
CN 102892346 A 1/2013

(Continued)

OTHER PUBLICATIONS

Merriam-Webster, (n.d.). Actuate. In Merriam-Webster.com dictionary. Retrieved Sep. 15, 2020, from https://www.merriam-webster.com/dictionary/actuate (Year: 2020).*

(Continued)

*Primary Examiner* — Michael E Barr
*Assistant Examiner* — Omair Chaudhri
(74) *Attorney, Agent, or Firm* — Boyle Fredrickson, S.C.

(57) ABSTRACT

A wash-aid dispenser (20) for dispensing dishwasher detergent and rinse-aid employs a DC motor (46) and drive train (43) to separately actuate a door (23) for the release of detergent and a valve (21) for the release of rinse-aid allowing reduced noise and reduce energy operation using a single electric actuator.

17 Claims, 5 Drawing Sheets

(52) U.S. Cl.
CPC ..... *A47L 2401/30* (2013.01); *A47L 2501/07* (2013.01); *A47L 2501/26* (2013.01)

(56) References Cited

U.S. PATENT DOCUMENTS 4,488,666 A * 12/1984 Herbst ..... A47L 15/0052 134/134
6,098,646 A * 8/2000 Hennemann ..... B01F 15/0416 137/101.19
2002/0153029 A1* 10/2002 Cerruti ..... A47L 15/4409 134/29
2003/0188768 A1* 10/2003 Cerruti ..... A47L 15/4409 134/57 D
2009/0145922 A1* 6/2009 Cerruti ..... A47L 15/4409 222/1
2009/0235962 A1* 9/2009 Classen ..... A47L 15/4454 134/57 D
2010/0161143 A1* 6/2010 Smith ..... D06F 39/022 700/283
2012/0125366 A1* 5/2012 Beshears, Jr ..... A47L 15/4293 134/18
2016/0143506 A1* 5/2016 Van Tol ..... A47L 15/4418 134/57 D
2016/0220094 A1* 8/2016 Durham ..... A47L 15/4409
2017/0319044 A1* 11/2017 Szalas ..... A47L 15/449

FOREIGN PATENT DOCUMENTS

CN 105283111 A 1/2016
DE 102013101157 A1 8/2014
EP 0457137 A1 11/1991
EP 0860141 A2 * 8/1998 ..... A47L 15/44
EP 0602572 B1 * 7/2002 ..... A47L 15/4409
FR 2532667 A1 * 3/1984 ..... D06F 33/06
WO 2014102369 A1 7/2014

OTHER PUBLICATIONS

International Search Report for PCT/US2017/030537.

* cited by examiner

MOTOR DRIVEN IN-DOOR DISHWASHER AID DISPENSER

CROSS REFERENCE TO RELATED APPLICATIONS

The present application claims the benefit of U.S. provisional application 62/343,959 filed Jun. 1, 2016 and hereby incorporated by reference.

FIELD OF THE INVENTION

The present invention relates to automatic dishwashing machines (dishwashers) and in particular to dishwashers providing automatic dispensing of washing aid over successive washing sessions.

BACKGROUND OF THE INVENTION

Dishwashers, such as those found in many homes, provide a wash cavity holding one or more racks into which dishes, flatware, and the like may be placed for cleaning. The wash cavity may be sealed by a door opening at the front of the wash cavity to allow loading and unloading of the cavity but then closed during a washing cycle to prevent the escape of water sprayed within the volume of the wash cavity. Upon completion of the washing cycle, a drying cycle is initiated during which water is drained from the wash cavity and moist air is discharged through a vent or the like.

A washing session may include a pre-wash portion in which the dishes are rinsed with or without the application of detergent. Accordingly, most dishwashers provide for automatic detergent dispensing, for example, from an in-door dispenser, that can be automatically triggered at a later time than the wash cycle begins. A separate dispenser may provide an actuator for dispensing a rinse-aid, typically during the rinse cycle, such as assists in drying of the dishes and reduces water spotting.

An electrical solenoid may be used in the dispenser to activate mechanisms releasing detergent and rinse-aid. Typically, a single electrical solenoid operates to simultaneously dispense detergent and rinse-aid thereby reducing complexity and cost of the dispenser. At a time when detergent should be dispensed, the solenoid operates briefly to release a spring-loaded door covering a chamber holding the detergent while also dispensing a small amount of rinse-aid. This small amount of dispensed rinse-aid is an accommodation to the use of a single actuator.

At a time when rinse-aid should be dispensed, the spring-loaded door containing the detergent has already been opened and the detergent fully dispensed; accordingly the solenoid may be operated over a length of time necessary to release operative amounts of rinse-aid without concern about the detergent dispenser.

The rapid motion of an electrical solenoid can create substantial noise. In addition an electrical solenoid may consume significant electrical power when operated for an extended duration during the dispensing of rinse-aid. Slower, relatively quiet actuators such as wax motors and bimetallic elements can significantly reduce the actuation noise of the dispenser but may be insufficiently fast in response to allow a single actuator to release the detergent door while minimizing undesired dispensing of the rinse-aid. Wax motors and bimetallic elements, like solenoids, consume power while actuated.

SUMMARY OF THE INVENTION

The present invention provides an automatic washing aid dispenser employing a low-voltage DC motor to dispense both detergent and rinse-aid with reduced noise. A gear train and position sensing system allows electrical power to be used only during transition between states and not during actuation time during which the motor may be deactivated. In one embodiment, the invention allows independent dispensing of detergent and rinse-aid eliminating waste of rinse-aid as well as the noise generated during a high-speed, short duration actuation.

Specifically, the invention provides a wash-aid dispenser for dishwashers having a rinse-aid reservoir adapted to hold a liquid rinse-aid and including a valve for dispensing a rinse-aid from the reservoir into the dishwasher and having a detergent chamber adapted to hold dishwasher detergent and including a door openable to dispense the detergent from the detergent chamber. An electric actuator comprising a DC electric motor and gear reducer provides an actuation output communicating with both the valve and door to dispense rinse-aid and detergent with operation of the DC electric motor.

It is thus a feature of at least one embodiment of the invention to provide a low noise actuator that can operate both the rinse-aid dispenser and the determent dispenser with low energy consumption.

The wash-aid dispenser may further include a sensor sensing the position of the actuation output.

It is thus a feature of at least one embodiment of the invention to permit closed-loop control of the actuator output to permit multiple states of actuator output to be generated, for example, more than two states with a single polarity motor drive, and typically more than three states.

The actuation output is movable between a first position actuating only the door of the detergent chamber, a second position actuating only the valve of the rinse-aid reservoir and a third position actuating neither the door of the detergent chamber nor the valve of the rinse-aid reservoir.

It is thus a feature of at least one embodiment of the invention to permit separate activation of the detergent chamber and rinse-aid reservoir to eliminate rinse-aid waste.

The sensor may provide a sensor output distinguishing among the first, second, and third positions.

It is thus a feature of at least one embodiment of the invention to permit the control system to readily distinguish between the three activation states without precise timing.

The sensor may further provide a sensor output distinguishing a fourth position actuating neither the door of the detergent chamber nor the valve of the rinse-aid reservoir immediately after actuation of the rinse-aid reservoir and wherein the third position is an actuation of neither the door of the detergent chamber nor the valve of the rinse-aid reservoir immediately after actuation of the door of the detergent chamber.

It is thus a feature of at least one embodiment of the invention to permit the rinse-aid dispenser to stop for an arbitrary period of time in between each state of dispensing to provide truly independent dispensing.

The sensor may further provide an output distinguishing a fifth position indicating a closing of the valve of the rinse-aid reservoir and wherein the second position is an opening of the valve of the rinse-aid reservoir.

It is thus a feature of at least one embodiment of the invention to provide a positive indication of rinse aid valve closure for more reliable operation permit.

The gear reducer may include at least one gear providing a first cam surface and a follower activating an electrical contact to form the sensor. In addition or alternatively the gear may further provide a second cam surface actuating the valve of the rinse-and-reservoir. In addition or alternatively the gear may further provide a third cam surface actuating the door of the detergent chamber.

It is thus a feature of at least one embodiment of the invention to provide a simple mechanism by using a highly speed-reduced gear to provide independent high-resolution control of rinse-aid dispensing and detergent dispensing as well as signaling to the controller for control of the rinse-aid dispensing and detergent dispensing.

The gear train may include a worm gear attached to a shaft of the DC motor communicating with a set of at least two inter-engaging helical gear pairs providing a reduction of speed.

It is thus a feature of at least one embodiment of the invention to provide an extremely low profile dispenser suitable for use with typical dishwasher doors by extending the axis of the motor perpendicularly to the gear train.

The door of the detergent chamber may be spring-loaded to open upon actuation to be opened but not closed by the actuation output, and the valve of the rinse-aid chamber is both openable and closable by the actuation output.

It is thus a feature of at least one embodiment of the invention to eliminate the need for the DC motor to provide power for opening the door thus reducing the power requirement of the DC motor and eliminating mechanical binding problems if the door is blocked by cutlery or dishes or detergent encrustation.

The wash-aid dispenser may be adapted to mount to a dishwasher door hingeably movable between a horizontal and vertical position and may further include a fill-port communicating with the rinse-aid chamber for the introduction of rinse-aid into the rinse-aid chamber, and the fill-port may provide an entrance channel directed upward when a door on which the rinse wash-aid dispenser is attached is in the vertical position.

It is thus a feature of at least one embodiment of the invention to provide a fill-port that naturally resists inflow of wash water during use without the need for a cap that must be removed by the consumer and such as may be misplaced or dropped into the dishwasher.

The fill-port may be behind the door of the detergent chamber when the door of the detergent chamber is in the opened position.

It is thus a feature of at least one embodiment of the invention to limit the direction of water impinging on the fill-post during a majority of the cleaning cycle to maximize the effectiveness of the fill-port entrance channel.

The wash-aid dispenser may further include an enclosed channel extending along an upper wall of the detergent chamber to be covered by the door of the detergent chamber when the door of the detergent chambers in the closed position and to cooperate with the door of the detergent chamber when the door of the detergent chambers in the opened position to funnel water along the inner surface of the door of the detergent chamber into the enclosed channel to a rear wall of the detergent chamber to flush detergent from the detergent chamber.

It is thus a feature of at least one embodiment of the invention to positively conduct water fully to the rear of the detergent chamber to flush the detergent chamber without the risk of premature wetting of the detergent from distributed spray prior to full discharge.

The door of the detergent chamber in the opened position may provide a conduit between the door of the detergent chamber and a body portion of the wash-aid dispenser receiving water from the dishwasher during a washing cycle.

It is thus a feature of at least one embodiment of the invention to positively fennel water into the detergent chamber by using the door as a conduit.

The wash-aid dispenser maybe adapted to mount to a dishwasher door hingeably movable between a horizontal and vertical position and may farther include an optical sensor positioned to detect a height of rinse-aid in the rinse-aid chamber below an identical single predetermined volume both when the door is in the horizontal and in the vertical position.

It is thus a feature of at least one embodiment of the invention to permit accurate measurement of rinse-aid both when the consumer is filling the rinse-aid reservoir and when the door is in the upright position in preparation for or during washing.

The wash-aid dispenser may further include a first and second optical sensor position to detect a height of the rinse-aid in the rinse chamber below a single predetermined first volume and above a second predetermined volume and further including an indicator indicating to a user both conditions of the rinse-aid in the rinse chamber being below the first volume and alternatively above the second volume.

It is thus a feature of at least one embodiment of the invention to provide the user with guidance not only as to when to fill the rinse-aid chamber but to also prevent over filling of the rinse-aid chamber such as may waste rinse-aid.

These particular features and advantages may apply to only some embodiments falling within the claims and thus do not define the scope of the invention.

DETAILED DESCRIPTION OF THE PREFERRED EMBODIMENT

Figure 1:
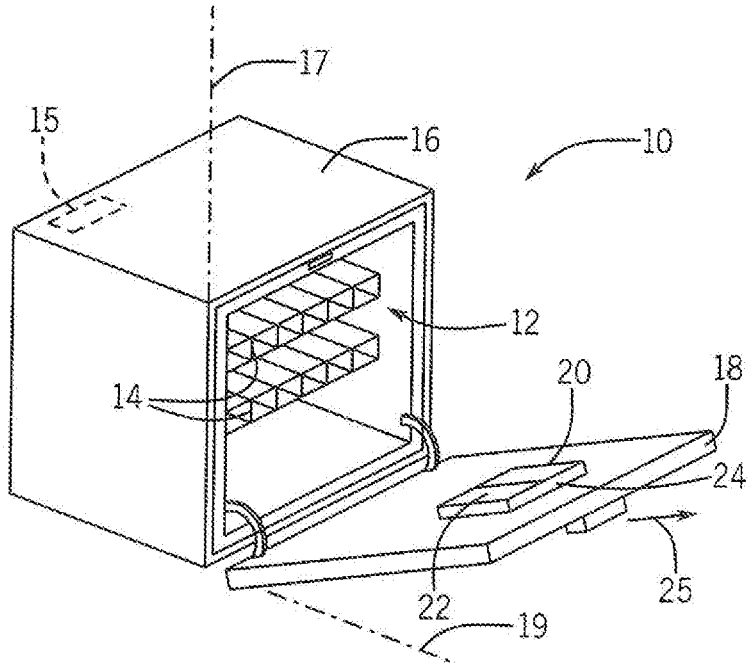
FIG. 1 is a perspective view of a wash cavity of a dishwasher showing the dishwasher housing and door when the door is in the open position with the dispenser system of the present invention supported on an exposed inner surface of the door.

Referring how to FIG. 1, a dishwasher 10 may include a wash cavity 12 into which dishes and cutlery may be placed for cashing on racks 14. The wash cavity 12 may be defined by a generally rectangular housing 16 open at a front surface to provide a scalable volume when covered by a dishwasher door 18. The dishwasher door 18 seals against a from lip of the housing 16 by means of a gasket or the like (not shown) when the dishwasher door 18 is in a vertical position with a door axis 25 of the dishwasher door 18 (parallel to a broad inner surface of the dishwasher door 18) aligned with axis 17. The dishwasher door 18 may also open to a horizontal position with door axis 25 aligned along horizontal axis 19 for access to the wash cavity 12.

In the sealed position, the inner surface of the dishwasher door 8 is exposed to the wash cavity 12 and may support a washing aid dispenser 20 on the inner surface of the dishwasher door 18 to dispense washing aids directly into the wash cavity 12. The washing aid dispenser 20 includes both a detergent chamber 22 and a rinse-aid reservoir 24 to allow dispensing of two different wash-aids. When the dishwasher door 18 is in the open horizontal position, the washing aid dispenser 20 is accessible to the user for refilling the detergent chamber 22 and rinse-aid reservoir 24 with detergent and rinse-aid, respectively, as will be discussed.

A controller 15, for example, providing an electronic microprocessor communicating with a memory holding a stored program, may communicate with the standard electrical components of the dishwasher 10 including water pumps, heaters and valves (not shown) to control them according to stored program wash cycles selectable by the user. In conjunction with these wash cycles, the controller 15 may control the washing aid dispenser 20 for the dispersing of detergent and rinse-aid. In this regard, the controller 15 will provide electrical signals to the washing aid dispenser 20 and respond to electrical signals from the washing aid dispense 20 as will be discussed below.

Figure 2:
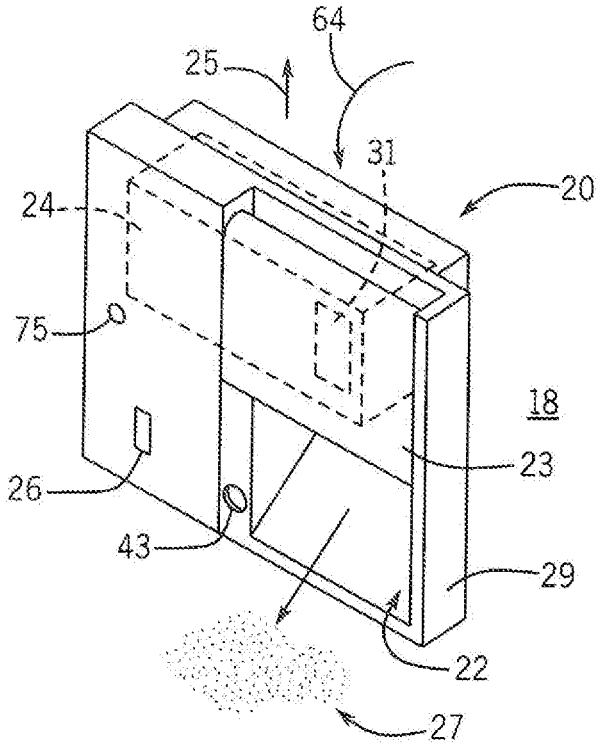
FIG. 2 is a perspective view of a front surface of the dispenser system of FIG. 1 such as faces the wash cavity showing the door in the open position for releasing detergent.
Figure 4:
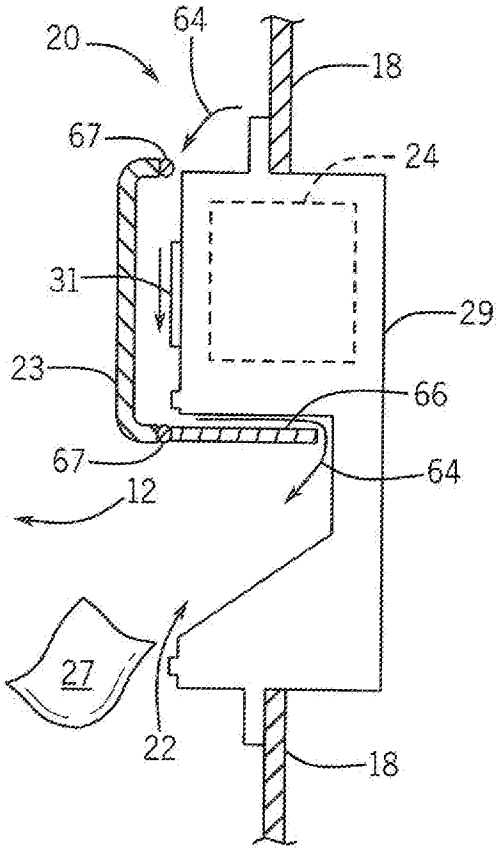
FIG. 4 is a figure similar to FIG. 3 showing the door in the open position such as works with an internal conduit in the detergent chamber in funnel water to the back of the detergent chamber to improve detergent release.
Figure 3:
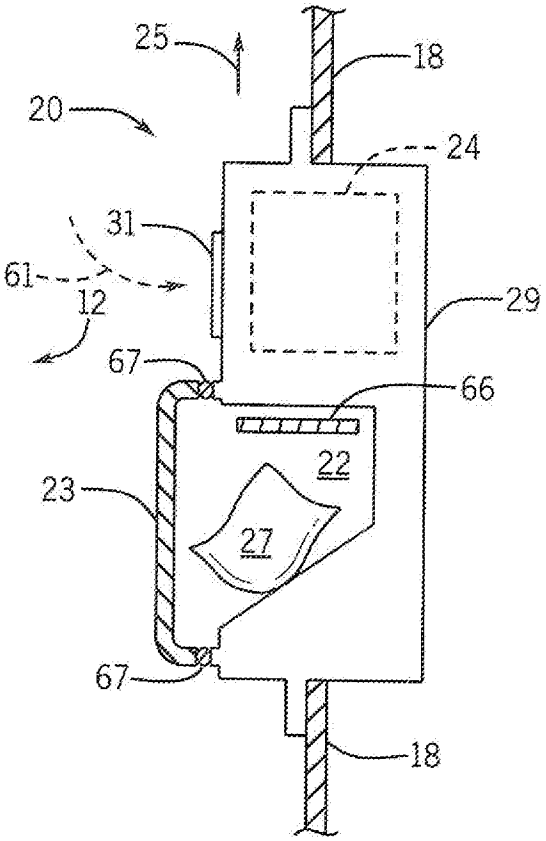
FIG. 3 is a simplified side cross-section of the detergent chamber showing the door in its closed position retaining detergent within the detergent chamber and allowing use of the fill-port.
Figure 5:
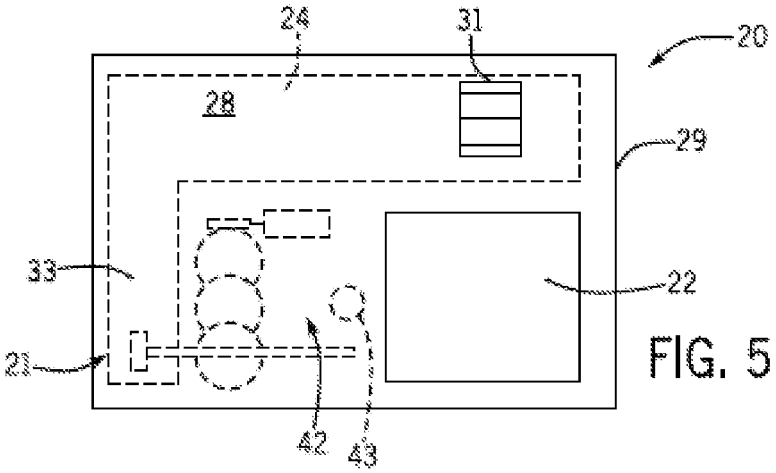
FIG. 5 is a front elevational view of the dispenser similar to that of FIG. 2 showing in phantom the actuator mechanism and rinse-aid cavity.

Referring now to FIGS. 2, 3 and 4, the washing aid dispenser 20 is depicted as mounted to an inner surface of the dishwasher door 18 when the dishwasher door 18 is in the vertical position. During operation, a detergent chamber 22 may hold detergent 27 as placed within a detergent chamber 12 by a consumer and be held within the detergent chamber 22 by a dispenser door 23 closing over the detergent chamber 22 (shown in FIG. 3). The dispenser door 23 may be mounted to the washing aid dispenser 20 to slide vertically between a lower, closed position (shown in FIG. 3) retaining the detergent 27 and an upper open portion (shown in FIGS. 2 and 4). Generally, the dispenser door 23 will be spring biased toward the upper position. When the dispenser door 23 is in the open position, detergent 27 will be dispensed into the washing cavity 12 aided by a sloped bottom wall of the detergent chamber 22.

Referring now to FIGS. 2 through 5, rinse-aid reservoir 24 may be contained within a body 29 of the washing aid dispenser 20 and may communicate with a fill-port 31 (as will be discussed below) that is generally accessible on the exposed outer surface of the washing aid dispenser 20 when the dispenser door 23 is in the closed position of FIG. 3. In contrast, when the dispenser door 23 is in the open position of FIG. 2, the fill-port 31 will be covered by the dispenser door 23.

The rinse-aid reservoir 24 may be filled with a liquid rinse-aid 28 which may communicate through a conduit 33 to a valve 21 dispensing the rinse-aid 28 through an outlet 26 (FIG. 2) in the front face of the washing aid dispenser 20 leading into the wash cavity 12. The valve 21 may be operated by electric actuator 42 that will be described in more detail below. This electric actuator 42 may also independently activate a door catch 47 (FIG. 7) controlling the release of the dispenser door 23 and detergent 27.

Figure 6:
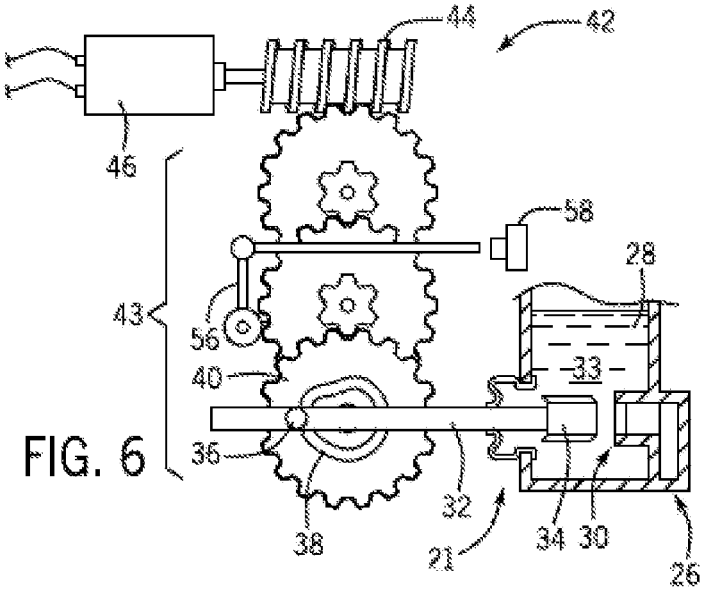
FIG. 6 is a fragmentary view of a gear train driven by a DC motor within the dispenser system of FIG. 1, the final gear of the gear train providing a cam for the release of rinse-aid from a rinse-aid chamber.
Figure 7:
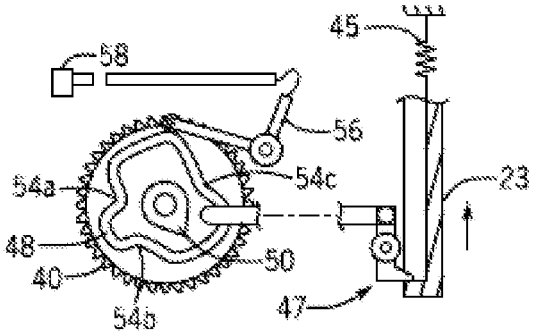
FIG. 7 is a figure of a back side of the final gear of the gear train of FIG. 2 showing additional cams for position sensing of the final gear and the opening of a detergent chamber door for the release of detergent.

Referring now to FIGS. 6 and 7, the opening of the outlet 26 from conduit 33 may form an internal valve seat 30 within the conduit 33 that may be covered or opened by movement of a plunger 32 having an elastomeric stopper 34 that may alternately engage or disengage with the valve seat 30. The other end of the plunger 32 outside of the conduit 33 (as sealed by a flexible bellows) provides a pin 36 following an eccentric cam track 38 in a final drive gear 40 of the electric actuator 42. In this way, rotation of the final drive gear 40 through one revolution may alternately open and close the valve 21 formed by the stopper 34 and valve seat 30 to dispense a predetermined amount of rinse-aid 28 into the wash cavity 12.

The drive gear 40 may be driven by a speed-reducing helical gear train 43, the first gear of which is driven along its outer toothed periphery by a worm gear 44 engaging the teeth of the first gear of the speed-reducing gear train 43 and driven in turn by a low-voltage DC motor 46, for example, operating at a voltage of less than six volts and desirably less than five volts. The worn gear 44 allows the shaft and longest extent of the motor 46 to be positioned in a plane parallel to the plane of the inner surface of the dishwasher door 18 for reduced housing thickness of the washing aid dispenser 20. The present inventors have determined that a low power DC motor 46 may be used in this capacity, eliminating the need for large-gauge wiring and/or high voltages required by other actuator types as is possible through the use of the speed-reducing gear train 43 such as permits the necessary energy needed for dispensing to be obtained at lower power over a period of time rather than instantaneously as would be required for a solenoid or the like.

Referring now to FIG. 7, the opposite side of the final drive gear 40 may provide for a sensor cam 48 within a concentric detergent door cam 50. The detergent door cam 50 actuates a catch 47 (shown schematically for clarity) that releases a spring-loaded dispenser door 23 so move from a closed position covering the dishwasher detergent chamber 22 to the open position opening the dishwasher detergent chamber 22 into the cavity 12 for the release of detergent from the detergent chamber 22 into the cavity 12. A spring 45 for biasing the dispenser door 23 toward the upper position is shown schematically only and will typically be a hairpin type spring for compactness and large actuation range. The detergent door cam 50 operates to release the door catch 47 once for each revolution of the final drive gear 40.

In contrast, the sensor cam 48 provides three reduced diameter sections 54*a*, 54*b* and 54*c* that cooperate with a cam follower arm 56 to press an electrical switch 58 three times during each revolution of the final drive gear 40 as these reduced diameter locations. These three times that, the electrical switch 58 is pressed (closed) include: during release of the dispenses door 23 and before and after dispensing of the rinse-aid.

Figure 8:
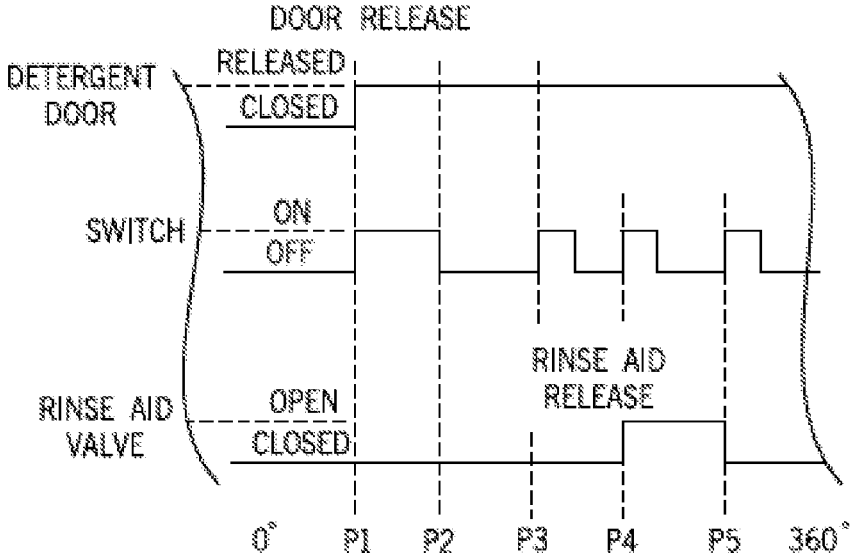
FIG. 8 is a timing diagram of the drive gear used for the separate dispensing of rinse-aid and solid detergent.

Referring now to FIGS. 6, 7 and 8, at a first rotary position P1 of the drive gear 40, the detergent door cam 50 will operate to release the door 23 and sensor cam 48 will briefly close the switch 58 to signal a controller. With continued rotation, the switch 58 opens again at position P2 providing a signal to a controller 15 that the detergent 27 (shown in FIG. 4) has been dispensed and allowing the motor 46 to be stopped before the dispensing of rinse-aid 28. This can be contrasted to other single actuator systems that necessarily dispense rinse-aid whenever the dispenser door is opened.

At a later time, the motor 46 may again be activated by the controller 15 according to a predefined washing cycle to move the final drive gear 40 to position P3. Here the cam track 38 serves to dispense rinse-aid 28 by opening the valve 21. At this time, the sensor cam 48 closes the switch 58 again at time P4 indicating a start of the dispensing of rinse-aid 28. The controller 15 may continue operation of the DC motor 46 to ensure consistent full opening of the valve 21 until the sensor cam 48 opens a switch 58 indicating that the valve 21 is fully open. At this time, the controller 15 may stop electrical power to the DC motor 46 to conserve power and to provide an arbitrary dispensing time of rinse-aid 28.

When a predetermined amount of time has passed consistent with the dispensing of rinse-aid 28 in an operative amount, the DC motor 46 may again be activated by the controller 15 moving the final drive gear 40 to position P5 indicating closure of the valve 21 and the conclusion of the dispensing of rinse-aid 28. At position P5, and the switch 58 is closed, again to signal to the controller 15 that it may stop the motor 46 by the controller 15 for the conclusion of the wash cycle or until an additional dispensing of rinse-aid 28 may be desired. It will be appreciated that after this point, subsequent, rotations of the final drive gear 40 can be used to dispense additional rinse-aid "shots" independent of further dispensing of detergent which is substantially completely dispensed at time P4.

Referring now also to FIGS. 2, 3 and 4, when the dispenser door 23 is released by the catch 47, the dispenser door 23 slides upward (as biased by a spring 45 shown schematically in FIG. 7) over a rinse-aid fill-port 31 which was previously exposed when the dispenser door 23 was closed over the detergent chamber 22. This feature of covering the rinse-aid fill-port 31 with the dispenser door 23 will reduce water entry to the rinse-aid fill-port 31 as will be discussed below.

Significantly, when the door opens, detergent 27 is released into the wash, cavity 12 and the dispenser door 23 becomes, a conduit for water 64 received on the top of the washing aid dispenser 20 and channeled downward between the inner surface of the dispenser door 23 and the outer surface of the body 29 of the washing aid dispenser 20. At the bottom of the dispenser door 23, a rearward elastomeric seal 67 on the dispenser door 23 connects to a front edge of a rearwardly extending false ceiling 66 of the detergent chamber 22 toward the back of the detergent chamber 22 where the channel opens releasing water to flush out any remaining detergent 27, an action promoted by a sharply downward sloping lower floor of the detergent chamber 22. As shown in FIG. 2, when the dispenser door 23 is in the uppermost position, there is a slot open between the body 29 of the washing aid dispenser 20 and the rear surface of the dispenser door 23 to promote water flow along this path. The false ceiling 66 provides a fully enclosed, conduit ensuring water passes felly to the back of the detergent chamber 22 and may have a slight downward slope in that direction to promote such water flow.

Figure 9:
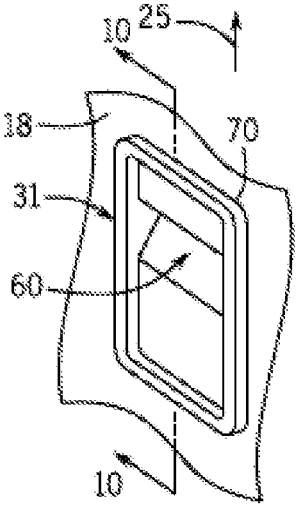
FIG. 9 is a perspective view of the fill-port to the rinse-aid chamber.
Figure 10:
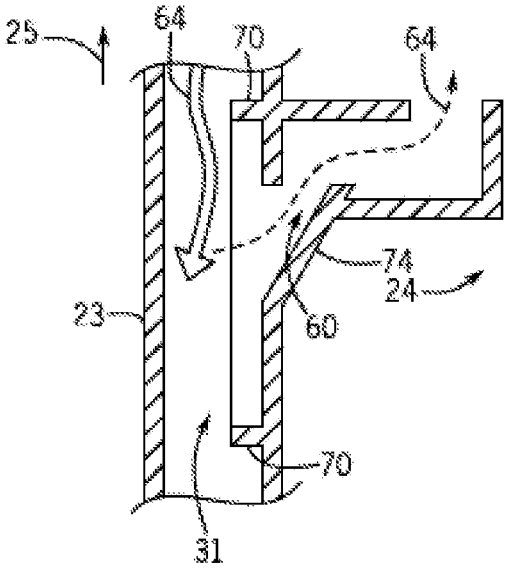
FIG. 10 is a fragmentary cross-section along lines 10-10 of FIG. 9 of an inlet port to the rinse-aid chamber that provides a counter-flow channel to eliminate the need for a separate cover for the rinse-aid chamber.

Referring now also to FIGS. 4, 9 and 10, when the dishwasher door 18 is in the vertical position, the dispenser door 23 ensures that water 64 is conducted generally downward across the fill-port 31 as indicated in FIG. 10. In this regard, the rinse-aid fill-port 31 has an outer guard ring 70 that diverts the descending water 64 around the rinse-aid fill-port 31 as water is conducted between the inner surface of the dispenser door 23 and the outer surface of the washing aid dispenser 20. In addition, an opening 60 in the fill-port 31 communicating with the internal rinse-aid reservoir 24 is displaced upwardly within the guard ring 70 to further resist the flow of water into the port 31. The opening 60 is accessible only by means of an upwardly directed channel 74 that resists entry of water into the opening 60, for example, during a prewash when the dispenser door 23 is closed. In order to flow through the upwardly directed channel 74, water 64 would have to reverse course and flow upward against gravity to enter into opening 60 as a result of the orientation of the channel 74. In contrast, when the dishwasher door 18 is in the open horizontal position, rinse-aid 28 may be readily introduced through the fill-port 31 as indicated by dotted arrow 61 following the normal downward path promoted by gravity into opening 60. In this respect the channel 74 may be angled generally in the direction of the door axis 25 and inwardly perpendicular to the surface of the dishwasher door 18. This design of the fill-port 31 eliminates the need for an additional cap or closure for the fill-port 31.

Referring now to FIGS. 2, 11, 12, and 13, the rinse-aid reservoir 24 may include a fill indicator light assembly 75 (shown in FIG. 2) including, for example, a green lamp a indicating a full rinse-aid reservoir 24 (at least 75 percent full) and a red lamp 77*b* indicating an empty rinse-aid reservoir 24 (less than 25 percent full). The signals may also be provided to the controller 15 or displayed elsewhere, for example, on the top or front of the door 18 (shown in FIG. 1). Generally the lamps may be LEDs or the like and will be positioned to be visible by the consumer when filling the rinse-aid reservoir 24.

Control of the indicator light assembly 75 may be provided by a control circuit 80 operating to provide electrical power to light emitting diodes 81*a* and 81*b* associated with prisms 82*a* and 82*b* passing through walls of the rinse-aid reservoir 24, the latter positioned to detect the level of rinse-aid 28. In particular, each prism 82 receives light from the respective light emitting diode 81 outside of the rinse-aid reservoir 24 directed toward a first 45-degree face of the prism 82 facing a second 45-degree face of the prism inside of the rinse-aid reservoir 24. These two opposed faces return the light along a parallel path to that emitted by light emitting diodes 81 to be received by respective light sensors 83*a* or 83*b* in the absence of rinse-aid contacting the faces of the prism 82. This is shown generally with respect to prism 82*a* being above a fill level 84 of rinse-aid 28 and results front the markedly different index of refraction between the material of the prism 82 and air in contact with the faces of the prism 82. In contrast, and with reference to prism 82*b*, the index of refraction of the material the prism 82 may be close to that of rinse-aid 28 causing light from light emitting diode 81*b* to be conducted into the rinse-aid 28 and relatively low amounts of light returned to the light sensor 83*b*. In this way, the control circuit 80 can detect the presence or absence of rinse-aid 28 covering the prisms 82 and can respond using a simple logic circuit to light lamp 77*a* if the signal from sensor 83*a* is below a predetermined threshold indicating the presence of rinse-aid 28 and to light red lamp 77*b* if the signal from sensor 83*b* is above a predetermined threshold indicating that no rinse-aid is covering prism 82*b*.

Generally prism 82*b* may be positioned to provide a signal determining whether the rinse-aid is above 25 percent of the volume of the rinse-aid reservoir 24 and prism 82*a* may be positioned to provide a signal, indicating whether the rinse-aid is below 75 percent of the volume of the rinse-aid reservoir 24. In this way the consumer may be encouraged not to overfill the rinse-aid reservoir 24 nor allow the rinse-aid reservoir 24 to be under filled.

Figure 11:
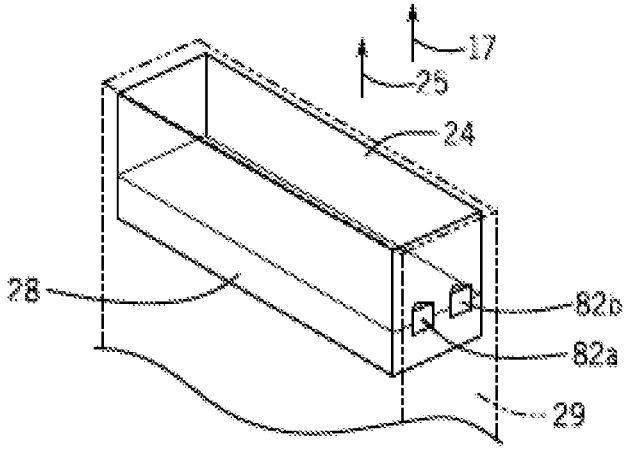
FIG. 11 is a simplified perspective view of the rinse-aid chamber showing the position of the light sensors for measuring rinse-aid height when the door is in the vertical upright position.
Figure 12:
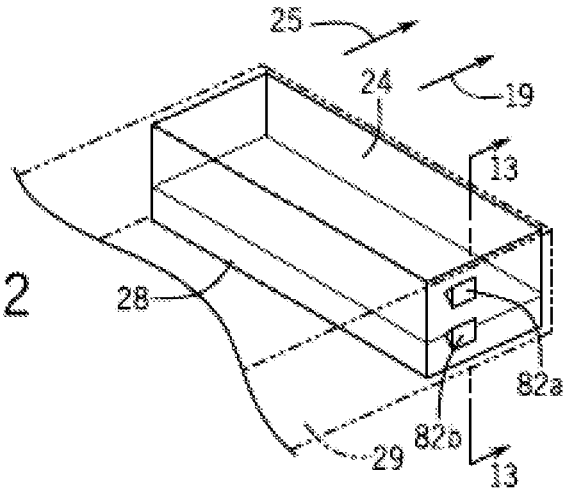
FIG. 12 is a figure similar to FIG. 11 showing the rinse-aid chamber when the door is in the horizontal open position.
Figure 13:
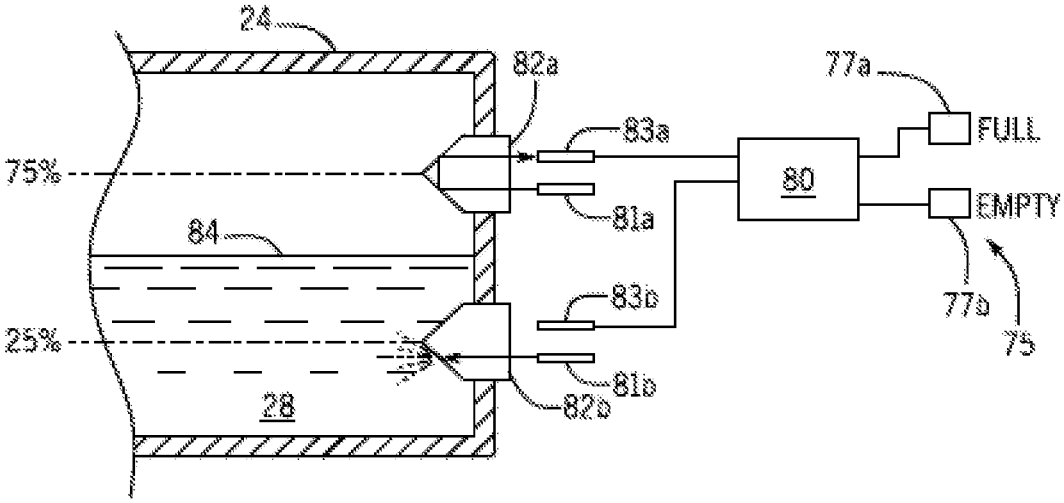
FIG. 13 is a cross-sectional view through the rinse-aid chamber showing a rinse-aid level sensor providing a light pipe that can operate with an LED driven by an electronic rinse-aid detector.

Referring now to FIGS. 11 and 12, generally the prisms 82*a* and 82*b* may be positioned so that prism 82*b* may sense a 25 percent fill level of the rinse-aid reservoir 24 when the dishwasher door 18 is in the closed position shown in FIG. 11 or when dishwasher door 18 is in the opened position shown in FIG. 12. In this way, the consumer may detect lower levels of rinse-aid 28 when the dishwasher door 18 is open and the consumer is filling the washing aid dispenser 20 or when the dishwasher door 18 is in its closed position and a signal is provided to the consumer through the top or front face of the dishwasher door 18 indicating low level of rinse-aid. This positioning of the prism 82*b* may be performed by providing the desired fill level of rinse-aid 28 and measuring its height in the rinse-aid reservoir 24 with the dishwasher door 18 open and making the same measurement when the dishwasher door 18 is closed and then positioning the prism 82*b* at the intersection of these two levels thereby accommodating a generally non-square cross-section of the rinse-aid reservoir 24 as well as the conduit 33 discussed above with respect to FIG. 5.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternate aspects of the present invention. The embodiments described herein explain the best modes known for practicing the invention and will enable others skilled in the art to utilize the invention.

What is claimed is:

1. A wash-aid dispenser for dishwashers comprising:

a rinse-aid reservoir adapted to hold a liquid rinse-aid and including a valve for dispensing a rinse-aid from the reservoir into the dishwasher;

a detergent chamber adapted to hold dishwasher detergent and including a door openable to dispense the detergent from the detergent chamber;

an electric actuator comprising a DC electric motor and gear reducer providing an actuation output communicating with both the door and the valve to separately dispense rinse-aid and detergent with operation of the DC electric motor, wherein the gear reducer includes:

a first engagement interface defined between a first portion of the gear reducer and a first actuation device providing a first actuation as the actuation output that drives the first actuation device that opens the door of the detergent chamber to dispense the detergent from the detergent chamber during a first dispensing event; and a second engagement interfaced defined between a second portion of the gear reducer and a second actuation device providing a second actuation as the actuation output that drives the second actuation device that moves the valve to dispense a volume of the rinse-aid from the rinse-aid reservoir during a second dispensing event; and a sensor operated by the gear reducer to indicate a status of the first and second dispensing events for controlling the DC electric motor.

2. The wash-aid dispenser for dishwashers of claim 1 wherein the sensor senses a position of the actuation output.

3. The wash-aid dispenser for dishwashers of claim 2 wherein the actuation output is movable between a first position actuating only the door of the detergent chamber, a second position actuating only the valve of the rinse-aid reservoir and a third position actuating neither the door of the detergent chamber nor the valve of the rinse-aid reservoir.

4. The wash-aid dispenser for dishwashers of claim 3 further wherein the sensor provides a sensor output distinguishing among the first, second, and third positions.

5. The wash-aid dispenser for dishwashers of claim 4 wherein the sensor further provides a sensor output distinguishing a fourth position actuating neither the door of the detergent chamber nor the valve of the rinse-aid reservoir immediately after actuation of the valve of the rinse-aid reservoir and wherein the third position is an actuation of neither the door of the detergent chamber nor the valve of the rinse-aid reservoir immediately after actuation of the door of the detergent chamber.

6. The wash-aid dispenser for dishwashers of claim 5 wherein the sensor further provides an output distinguishing a fifth position indicating a closing of the valve of the rinse-aid reservoir and wherein the second position is an opening of the valve of the rinse-aid reservoir.

7. The wash-aid dispenser for dishwashers of claim 4 further including a controller operating the DC motor in response to signals from the sensor to successively locate the output actuator in the first, second, and third positions at predetermined time intervals.

8. The wash-aid dispenser for dishwashers of claim 2 wherein the gear reducer includes at least one gear providing a first cam surface and a follower activating an electrical contact, wherein the electrical contact defines the sensor.

9. A wash-aid dispenser for dishwashers comprising:

a rinse-aid reservoir adapted to hold a liquid rinse-aid and including a valve for dispensing a rinse-aid from the reservoir into the dishwasher;

a detergent chamber adapted to hold dishwasher detergent and including a door openable to dispense the detergent from the detergent chamber;

an electric actuator comprising a DC electric motor and a gear reducer providing an actuation output communicating with both the door and the valve to separately dispense rinse-aid and detergent with operation of the DC electric motor, wherein the gear reducer includes:

a first portion providing a first actuation as the actuation output that opens the door of the detergent chamber to dispense the detergent from the detergent chamber during a first dispensing event;

a second portion providing a second actuation as the actuation output that moves the valve to dispense a volume of the rinse-aid from the rinse-aid reservoir during a second dispensing event;

at least one gear providing:

a first cam surface and a follower activating an electrical contact; and a second cam surface that provides the second portion of the gear reducer actuating the valve of the rinse-aid reservoir; and a sensor that senses a position of the actuation output and is defined by the electrical contact and is operated by the gear reducer to indicate a status of the first and second dispensing events for controlling the DC electric motor.

10. The wash-aid dispenser for dishwashers of claim 9 wherein the at least one gear further provides a third cam surface that provides the first portion of the gear reducer actuating the door of the detergent chamber.

11. The wash-aid dispenser for dishwashers of claim 1 wherein the gear reducer includes a worm gear attached to a shaft of the DC motor communicating a set of at least two inter-engaging gear pairs providing a reduction of speed.

12. The wash-aid dispenser for dishwashers of claim 1 wherein the door of the detergent chamber is spring-loaded to open upon actuation but not closed by the actuation output and the valve of the rinse-aid chamber is both openable and closable by the actuation output.

13. The wash-aid dispenser for dishwashers of claim 1 wherein the wash-aid dispenser is adapted to mount to a dishwasher door hingeably movable between a horizontal and vertical position and further including a fill-port communicating with the rinse-aid chamber for an introduction of rinse-aid into the rinse-aid chamber wherein the fill-port provides an entrance channel directed upward when a door on which the rinse wash-aid dispenser is attached is in the vertical position.

14. The wash-aid dispenser for dishwashers of claim 13 wherein the fill-port is behind the door of the detergent chamber when the door of the detergent chamber is in an opened position.

15. The wash-aid dispenser for dishwashers of claim 1 further including an enclosed channel extending along an upper wall of the detergent chamber to be covered by the door of the detergent chamber when the door of the detergent chamber is in a closed position and to cooperate with the door of the detergent chamber when the door of the detergent chambers in an opened position to funnel water along an inner surface of the door of the detergent chamber into the enclosed channel to a rear wall of the detergent chamber to flush detergent from the detergent chamber.

16. The wash-aid dispenser for dishwashers of claim 15 wherein the door of the detergent chamber in the opened position provides a conduit between the door of the detergent chamber and a body portion of the wash-aid dispenser receiving water from the dishwasher during a washing cycle.

17. The wash-aid dispenser for dishwashers of claim 1 wherein the wash-aid dispenser is adapted to mount to a dishwasher door hingeably movable between a horizontal and vertical position and further an optical sensor positioned to detect a height of rinse-aid in the rinse-aid chamber below an identical single predetermined volume both when the door is in the horizontal and in the vertical position.

* * * * *